United States Patent [19]

Torney

[11] Patent Number: 4,625,917

[45] Date of Patent: Dec. 2, 1986

[54] VARIABLE SPRAY SPRINKLER

[76] Inventor: Gary D. Torney, 173 Solano Ave., San Rafael, Calif. 94901

[21] Appl. No.: 820,009

[22] Filed: Jan. 21, 1986

[51] Int. Cl.[4] ..... A62C 31/00; A62C 37/20

[52] U.S. Cl. ..... 239/446; 239/DIG. 1; 239/444; 239/562

[58] Field of Search ..... 239/396, 436, 444, 446, 239/562, 563, DIG. 1; 137/68.1; 138/46

[56] References Cited

U.S. PATENT DOCUMENTS

| | | | |
|---|---|---|---|
| 2,949,241 | 8/1960 | Slonim | 239/DIG. 1 |
| 3,854,664 | 12/1974 | Hunter | 239/206 |
| 4,353,506 | 10/1982 | Hayes | 239/DIG. 1 |

*Primary Examiner*—Joseph F. Peters, Jr.
*Assistant Examiner*—Patrick N. Burkhart
*Attorney, Agent, or Firm*—Flehr, Hohbach, Test, Albritton & Herbert

[57] ABSTRACT

A sprinkler assembly with an arc adjustment plate that controls the sprinkler's spray pattern. The arc adjustment plate includes a multiplicity of removable slots. The pattern of removed slots controls the sprinkler's spray pattern. The sprinkler's head has a multiplicity of channels, distributed in a circular pattern around the sprinkler head, for spraying water. The slots of the arc adjustment plate are positioned at the inlets of these sprinkler channels. Therefore the unremoved slots in the arc adjustment plate block water from flowing through the corresponding sprinkler channels.

8 Claims, 4 Drawing Figures

VARIABLE SPRAY SPRINKLER

This invention relates generally to spray devices, and particularly to a sprinkler head for spraying water and other fluids upon lawns and crops.

BACKGROUND OF THE INVENTION

The prior art includes sprinkler systems which can generate a variety of spray patterns. See for example U.S. Pat. Nos. 2,943,798 (Rienks) and 2,949,241 (Slonim).

A shortcoming of the prior art sprinkler systems is that while these systems can be used to generate different spray patterns, each spray pattern requires the purchase or production of a special corresponding baffle or plate. Such systems do not allow for easy adjustment of the spray pattern in the field. Another consequence of the prior art systems is that the spray patterns available tend to be limited to quarter spray, half spray and full spray.

The present invention overcomes this shortcoming of the aforementioned prior art by providing an arc adjustment plate which allows in the field adjustment of a sprinkler's spray pattern.

An advantage of the present invention is that adjustment of the sprinkler's spray pattern can be made in small angular increments. Another advantage is that by providing one universal spray unit, the need for specialized parts for different spray patterns is eliminated.

It is therefore a primary object of the present invention to provide an improved sprinkler head which includes means for in the field spray pattern adjustment.

SUMMARY OF THE INVENTION

In summary, the present invention is a sprinkler assembly with an arc adjustment plate that controls the sprinkler's spray pattern. The arc adjustment plate includes a multiplicity of removable slots. The pattern of removed slots controls the sprinkler's spray pattern.

In the preferred embodiment, the sprinkler head has a multiplicity of channels, distributed in a circular pattern around the sprinkler head, for spraying water. The slots of the arc adjustment plate are positioned at the inlets of these sprinkler channels. Therefore the unremoved slots in the arc adjustment plate block water from flowing through the corresponding sprinkler channels.

In one preferred embodiment, a notch in the arc adjustment plate seats on a corresponding rib on the sprinkler base and fixes the orientation of the plate with respect the sprinkler base.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
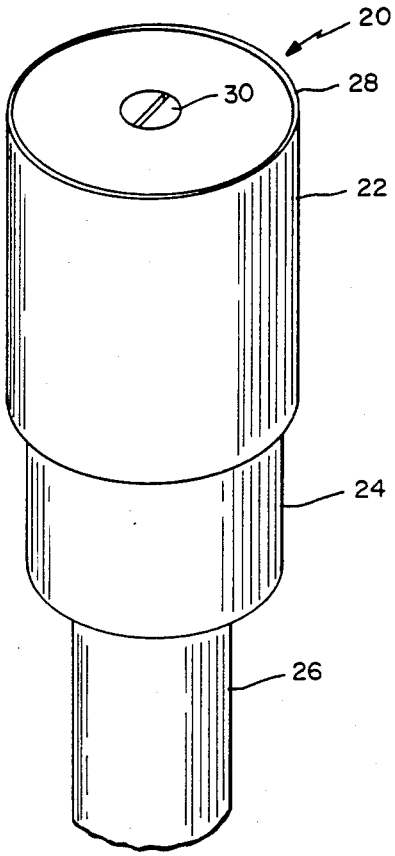
FIG. 1 depicts the exterior of a sprinkler in accordance with the present invention.

Referring to FIG. 1, there is shown a sprinkler assembly 20 including a sprinkler head 22 which is mounted on a base 24. The base 24 is coupled to a pipe called a riser 26 which connects the sprinkler 20 to a water supply. The riser 26 is typically threaded on its end and is not rotatable.

Water sprays from the sprinkler 20 through a slot 28 which is generally at or near the top of the sprinkler head 22. The rate at which water is sprayed is controlled by a flow adjustment screw 30.

The present invention concerns an apparatus for controlling the portion of the slot 28 through which water is sprayed, which is herein called the sprinkler's spray pattern.

Figure 2:
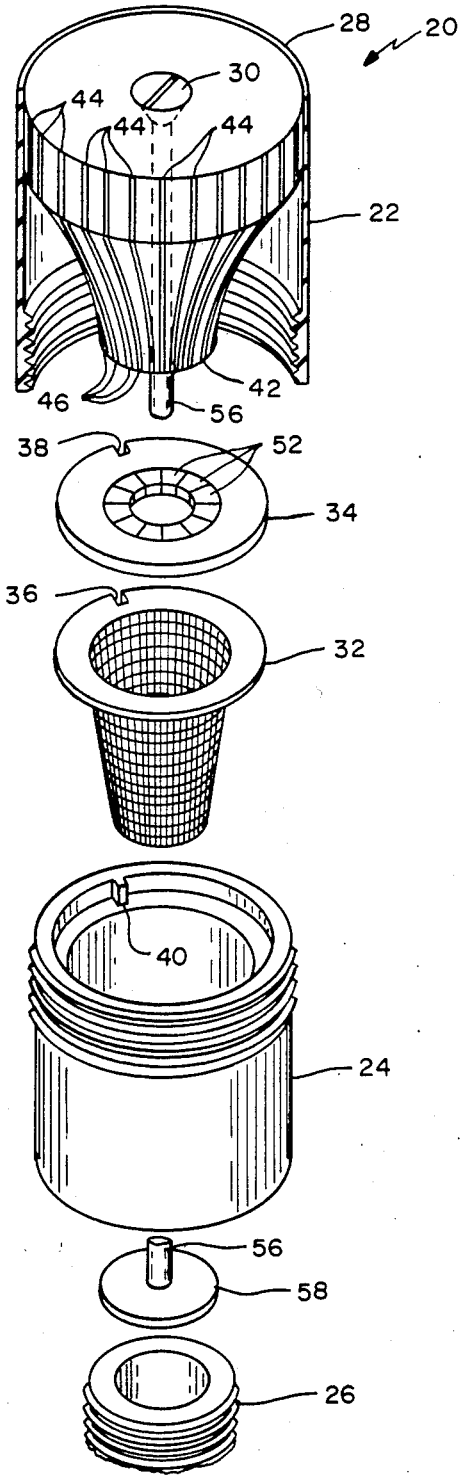
FIG. 2 is schematic diagram of the parts of a sprinkler in accordance with the present invention.

Referring to FIG. 2, the sprinkler base 24 is a cylindrical tube which connects the riser 26 to the sprinkler head 22. It also provides a seat for a filter screen 32, which prevents particulates in the water supply from clogging the sprinkler head 22, and an adjustment plate 34 which will be discussed in more detail below.

In the preferred embodiment, the filter screen 32 and the adjustment plate 34 contain notches 36 and 38, respectively, which seat on a corresponding rib 40 on the sprinkler base 24. This fixes the orientation of the adjustment plate 34 with respect to the base 24.

The sprinkler head 22 contains a funnel shaped member 42 which contains a multiplicity of water channels 44. All the water sprayed by the sprinkler 20 flows through these channels. Depending on the size of the sprinkler 20 and the size of the channels 44 used, the number of channels 44 in a typical sprinkler will be between 8 and 36. These channels 44 direct water from the base 24 to the discharge outlet at slot 28.

The adjustment plate 34 contains a multiplicity of removable slots 52 which are arranged in a circular pattern. When the sprinkler is assembled these slots 52 are positioned at the channel inlets 46 at the bottom of the funnel shaped member 42. Therefore the unremoved slots 52 in the arc adjustment plate 34 block water from flowing through the corresponding sprinkler channels.

The adjustment plate 34 is typically made of an appropriately selected plastic (such as a high-impact plastic) having an embossed die cut disk with removable tabs, herein called slots 52. The number of slots 52 need not correspond exactly to the number of channels, although having one slot for every one, two or three channels is preferred. What is required is that the number of slots 52 be sufficient to allow a useful level of control over the sprinkler's spray pattern.

While the adjustment plates 34A and 34B each originally had twelve removable slots 52, in other embodiments of the invention more or less slots could be provided as appropriate. In fact, different plates with different numbers of removable slots could be used with the same sprinkler assembly.

The adjustment plate 32 is designed so that any number of the slots 52 can be removed in the field using a variety of commonly available instruments, such as a screw driver, an awl, or a similarly small pointed instrument. Thus a gardener can successively remove slots from an adjustment plate 32 and test the resulting spray pattern until the desired spray pattern is achieved. By making the adjustment plate's slot pattern adjustable in the field the versatility of the sprinkler is greatly increased.

Figure 3A:
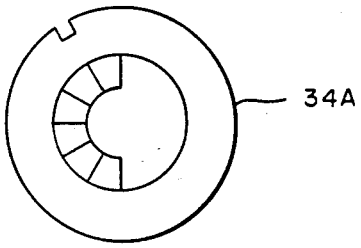
FIGS. 3A and 3B depict adjustment plates with slots removed for different spray patterns.
Figure 3B:
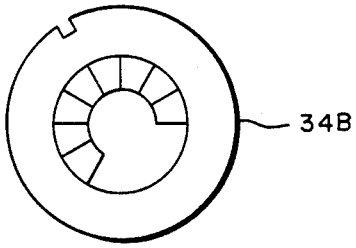

FIGS. 3A and 3B show two adjustment plates, one plate 34A with slots removed to form a half circle spray pattern, and one plate 34B with slots removed to form a one-third circle spray pattern.

The rate at which water flows through the sprinkler apparatus is controlled using a flow control apparatus well known in the prior art. Basically, a flow adjustment screw 30, when rotated, causes a rod 56 with a stopper plate 58 on its lower end to move either closer or further away from the end of the riser 26, depending on the direction in which the adjustment screw is twisted. Clearly, as the stopper plate 58 is pushed toward the riser 26 the flow of water through the sprinkler 20 is restricted and the thus the rate of water flow decreases. Similarly, moving the stopper plate 58 further away from the riser 26 increases the flow of water through the sprinkler 20.

In the preferred embodiment the orientation of the sprinkler's spray pattern can be set by first securely screwing the sprinkler 24 base onto the riser 26. Then, using the rib 40 on the base 25 and the notch 38 on the adjustment plate 34 as references, the appropriate slots 52 on an adjustment plate can be removed by removing slots 52 with the same angular relationship to the notch 38 as the desired spray pattern has to the rib 40.

In an alternate embodiment of this invention (not shown in the Figures) the sprinkler base 24 does not have a rib 40 and the filter screen 32 and adjustment plate 34 do not have notches 36 and 38. In this alternate embodiment, the orientation of the adjustment plate, which controls the orientation of the sprinkler's spray pattern, is controlled by twisting the sprinkler base 24 with respect to the riser 26 until the sprinkler's spray pattern is correctly oriented.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A sprinkler comprising:

a hollow base having means for its attachment to a supply line;

a head having means for water tight connection to said base and a multiplicity of channels for directing water to an elevated discharge outlet; and an arc adjustment plate having a mutiplicity of removable slots positioned at the inlets of said channels;

whereby the pattern of said removable slots which have been removed controls the sprinkler's spray pattern by controlling the channels through which water flows.

2. A sprinkler as set forth in claim 1, wherein said channels are arranged in a circular pattern and said removable slots are arranged in a corresponding circular pattern.

3. A sprinkler as set forth in claim 1, wherein said arc adjustment plate includes means for rigidly coupling said arc adjustment plate to said base at a fixed angular position.

4. A sprinkler as set forth in claim 1, wherein said arc adjustment plate is made of high-impact plastic.

5. A sprinkler as set forth in claim 1, wherein said removable slots in said arc adjustment plate comprise embossed die cut segments which can be broken away or otherwise removed with a small pointed instrument.

6. A sprinkler as set forth in claim 5, wherein said channels are arranged in a circular pattern and said removable slots are arranged in a corresponding circular pattern.

7. A sprinkler as set forth in claim 6, wherein said arc adjustment plate includes means for rigidly coupling said arc adjustment plate to said base at a fixed angular position.

8. A sprinkler as set forth in claim 7, wherein said arc adjustment plate is made of high-impact plastic.

* * * * *